US012366058B2

(12) United States Patent
Qiu

(10) Patent No.: US 12,366,058 B2
(45) Date of Patent: Jul. 22, 2025

(54) FIXING ASSEMBLY AND FAUCET

(71) Applicant: WENZHOU FURUISI BUILDING MATERIALS CO., LTD., Wenzhou (CN)

(72) Inventor: Chunhe Qiu, Wenzhou (CN)

(73) Assignee: WENZHOU FURUISI BUILDING MATERIALS CO., LTD., Wenzhou (CN)

( * ) Notice: Subject to any disclaimer, the term of this patent is extended or adjusted under 35 U.S.C. 154(b) by 383 days.

(21) Appl. No.: 17/945,119

(22) Filed: Sep. 15, 2022

(65) Prior Publication Data

US 2024/0068209 A1 Feb. 29, 2024

(30) Foreign Application Priority Data

Aug. 24, 2022 (CN) ..... 202222256234.5

(51) Int. Cl.
*E03C 1/04* (2006.01)

(52) U.S. Cl.
CPC ..... *E03C 1/0401* (2013.01)

(58) Field of Classification Search
CPC ..... E03C 1/0401
USPC ..... 4/695
See application file for complete search history.

(56) References Cited

U.S. PATENT DOCUMENTS 7,896,025 B2 * 3/2011 Hanson ..... E03C 1/04 137/454.6
2020/0102724 A1 * 4/2020 Rosko ..... E03C 1/0401

* cited by examiner

*Primary Examiner* — Lauren A Crane

(57) ABSTRACT

The present disclosure provides a fixing assembly, configured to mount a faucet with a countertop, the faucet includes a mounting sleeve passed through the countertop and configured to mount a water pipe assembly, the fixing assembly includes a fixing member including a first through hole and at least one via hole communicated with the first through hole, the first through hole and the via hole are configured to facilitate the water pipe assembly to pass through the fixing member, and the fixing member is sleeved on the mounting sleeve and retained against the countertop, to mount the faucet with the countertop. The present disclosure provides a faucet. The fixing assembly can secure the faucet with the countertop.

20 Claims, 7 Drawing Sheets

FIXING ASSEMBLY AND FAUCET

FIELD

The present disclosure relates to the technical field of faucets, specifically to a fixing assembly, and a faucet applying the fixing assembly.

BACKGROUND

After the faucet is mounted on the countertop and used for a long time, the connection between the faucet and the countertop is prone to loosening, so it is difficult to stably mount the faucet on the countertop, and thereby the user experience is poor.

SUMMARY

The present disclosure provides a fixing assembly, aiming at solving the problem that the faucet is difficult to be stably mounted on the countertop.

To achieve the above purpose, the present disclosure provides a fixing assembly, configured to mount a faucet with a countertop, the faucet includes a mounting sleeve passed through the countertop and configured to mount a water pipe assembly, the fixing assembly includes a fixing member including a first through hole and at least one via hole communicated with the first through hole, the first through hole and the via hole are configured to facilitate the water pipe assembly to pass through the fixing member, and the fixing member is sleeved on the mounting sleeve and retained against the countertop, to mount the faucet with the countertop.

In at least one embodiment, the fixing member is circular shaped, oval shaped, square shaped, or irregular shaped.

In at least one embodiment, the via hole extends through two opposite surfaces of the fixing member; and/or the via hole extends into and about a wall of the first through hole; and/or a quantity of the at least one via hole is more than one, and the at least one via hole are spaced apart from each other or opposite to each other.

In at least one embodiment, the first through hole extends through two opposite surfaces of the fixing member; and/or a wall of the first through hole includes an inner thread, the inner thread is connected with an outer thread of the mounting sleeve.

In at least one embodiment, the fixing member further defines at least one second through hole, and the fixing assembly further includes at least one retaining member, the retaining member is received in the second through hole and retained against the countertop, so as to mount the faucet with the countertop.

In at least one embodiment, when the fixing member is oval, the fixing member includes two long ends opposite to each other, the second through hole is defined in the long end.

In at least one embodiment, wherein the first through hole is separated from the second through hole.

In at least one embodiment, the fixing assembly further includes a handle connected with the fixing member, the handle defines a third through hole communicated with the first through hole, the handle is mounted on the mounting sleeve.

In at least one embodiment, the handle is provided with at least one protrusion; and/or the handle and the fixing member are integrally formed as a single unit.

The present disclosure further provides a faucet, which includes a protecting sleeve, a water pipe assembly, a mounting sleeve, and the fixing assembly.

In at least one embodiment, the water pipe assembly includes an outlet pipe and a connecting member connected with the outlet pipe, a size of the via hole is greater than a size of the connecting member.

In at least one embodiment, the fixing assembly further includes at least one washer, the washer is sandwiched between the countertop and the fixing member, the fixing member is sleeved on the mounting sleeve and retained against the washer, to mount the faucet with the countertop.

In at least one embodiment, the fixing member further defines at least one second through hole, and the fixing assembly further includes at least one retaining member, the retaining member is received in the second through hole and retained against the washer, so as to mount the faucet with the countertop.

In at least one embodiment, when the fixing member is oval, the fixing member includes two long ends opposite to each other, the second through hole is defined in the long end.

In at least one embodiment, the first through hole is separated from the second through hole.

In at least one embodiment, the fixing member is circular shaped, oval shaped, square shaped, or irregular shaped.

In at least one embodiment, the first through hole extends through two opposite surfaces of the fixing member; and/or a wall of the first through hole includes an inner thread, the inner thread is connected with an outer thread of the mounting sleeve.

In at least one embodiment, the via hole extends through two opposite surfaces of the fixing member; and/or the via hole extends into and about a wall of the first through hole; and/or a quantity of the at least one via hole is more than one, and the at least one via hole are spaced apart from each other or opposite to each other.

In at least one embodiment, the fixing assembly further includes a handle connected with the fixing member, the handle defines a third through hole communicated with the first through hole, the handle is mounted on the mounting sleeve.

In at least one embodiment, the handle is provided with at least one protrusion; and/or the handle and the fixing member are integrally formed as a single unit.

In the technical solution of the present disclosure, the fixing assembly includes a fixing member, and the fixing member defines a first through hole and at least one via hole communicated with the first through hole. The water pipe assembly can easily pass through the fixing member by the first through hole and the via hole. The fixing member is sleeved on the mounting sleeve and retained against the countertop, so as to securely mount the faucet with the countertop.

BRIEF DESCRIPTION OF THE DRAWINGS

Implementations of the present disclosure will now be described, by way of embodiment, with reference to the attached FIGS. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
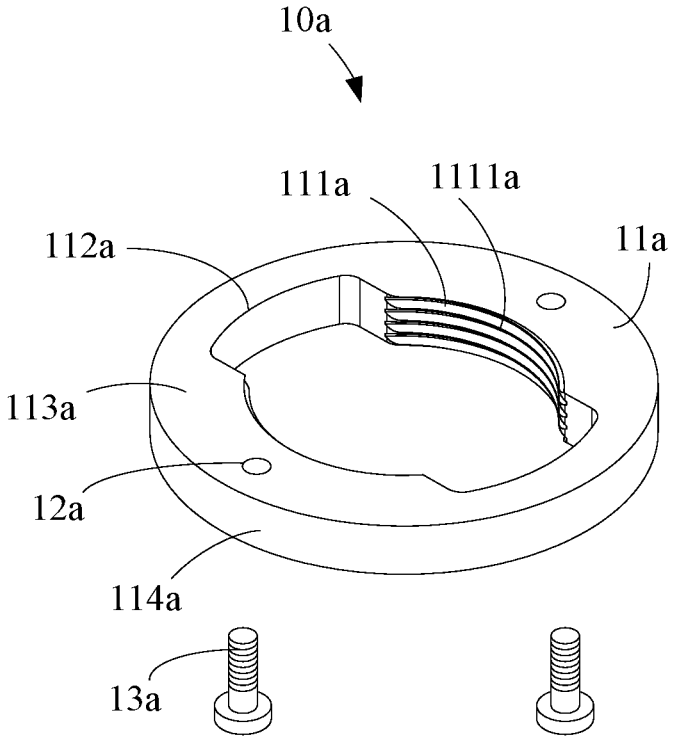
FIG. 1 is a structure diagram of a fixing assembly according to a first embodiment of the present disclosure.

The realization of the aim, functional characteristics, advantages of the present disclosure are further described specifically with reference to the accompanying drawings and embodiments.

DETAILED DESCRIPTION

It will be appreciated that for simplicity and clarity of illustration, where appropriate, reference numerals have been repeated among the different FIGS. to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion in the so-described combination, group, series, and the like. the present disclosure is illustrated by way of example and not by way of limitation in the FIGS. of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

Please referring to FIG. 1, the present disclosure provides a fixing assembly 10*a* according to a first embodiment. The fixing assembly 10*a* is used to mount a faucet 100 with a countertop 200. The faucet 100 includes a mounting sleeve 50 extended through the countertop 200 and configured to mount a water pipe assembly 40.

The fixing assembly 10*a* includes a fixing member 11*a*, and the fixing member 11*a* defines a first through hole 111*a* and at least one via hole 112*a* communicated with the first through hole 111*a*. The first through hole 111*a* and the via hole 112*a* are configured to facilitate the water pipe assembly 40 to pass through the fixing member 11*a*. The fixing member 11*a* is sleeved on the mounting sleeve 50 and retained against the countertop 200, so as to mount the faucet 100 with the countertop 200.

In at least one embodiment, the fixing member 11*a* is circular shaped, square shaped, or irregular shaped.

In at least one embodiment, the via hole 112*a* extends into and about a wall of the first through hole 111*a*.

In at least one embodiment, a quantity of the at least one via hole 112*a* is more than one, and the at least one via hole 112*a* are spaced apart from each other or opposite to each other.

In at least one embodiment, the first through hole 111*a* extends through two opposite surfaces 113*a* of the fixing member 11*a*.

In at least one embodiment, the first through hole 111*a* does not extend through a side wall 114*a* of the fixing member 11*a*, so the fixing member 11*a* has a good strength.

In at least one embodiment, the via hole 112*a* extends through two opposite surfaces 113*a* of the fixing member 11*a*.

In at least one embodiment, the via hole 112*a* does not extend through the side wall 114*a* of the fixing member 11*a*, so the fixing member 11*a* has a good strength.

In at least one embodiment, a wall of the first through hole 111*a* includes an inner thread 1111*a*, the inner thread 1111*a* is connected with an outer thread 51 of the mounting sleeve 50.

In the technical solution of the present disclosure, the fixing assembly 10*a* includes a fixing member 11*a*, and the fixing member 11*a* defines a first through hole 111*a* and at least one via hole 112*a* communicated with the first through hole 111*a*. The water pipe assembly 40 can easily pass through the fixing member 11*a* by the first through hole 111*a* and the via hole 112*a*. The fixing member 11*a* is sleeved on the mounting sleeve 50 and retained against the countertop 200, so as to securely mount the faucet 100 with the countertop 200.

The fixing member 11*a* further defines at least one second through hole 12*a*, and the fixing assembly 11*a* further includes at least one retaining member 13*a*, the retaining member 13*a* is received in the second through hole 12*a* and retained against the countertop 200, so as to secure the faucet 100 on the countertop 200.

In at least one embodiment, the retaining member 13*a* is retained against a surface of the countertop 200 adjacent to the fixing member 11*a*.

In at least one embodiment, the retaining member 13*a* is extended out of the second through hole 12*a* and retained against the surface of the countertop 200 adjacent to the fixing member 11*a*.

In at least one embodiment, a free end of the retaining member 13*a* is flush with a surface of the fixing member 11*a* adjacent to the countertop 200, and retained against the surface of the countertop 200 adjacent to the fixing member 11*a*.

In at least one embodiment, the free end of the retaining member 13*a* is extended out of the surface of the fixing member 11*a* adjacent to the countertop 200, and retained against the surface of the countertop 200 adjacent to the fixing member 11*a*.

In the technical solution of the present disclosure, the fixing member 11*a* defines at least one second through hole 12*a*, and the fixing assembly 10*a* further includes at least one retaining member 13*a*, the retaining member 13*a* is accommodated in the second through hole 12*a*, and retained against the surface of the countertop 200 adjacent to the fixing member 11*a*, so as to secure the faucet 100 with the countertop 200.

Figure 2:
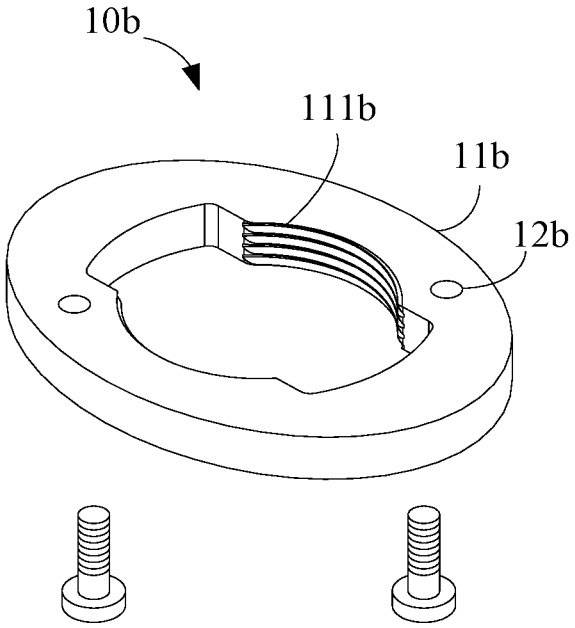
FIG. 2 is a structure diagram of a fixing assembly according to a second embodiment of the present disclosure.

Referring to FIG. 2, the present disclosure provides a fixing assembly 10*b* according to a second embodiment. The fixing assembly 10*b* according to the second embodiment is similar in structure to the fixing assembly 10*a* according to the first embodiment. The difference between the fixing assembly 10*b* and the fixing assembly 10*a* at least includes: the fixing member 11*b* is oval shaped.

In at least one embodiment, the second through hole 12*b* is spaced apart from the first through hole 111*b*.

Figure 3:
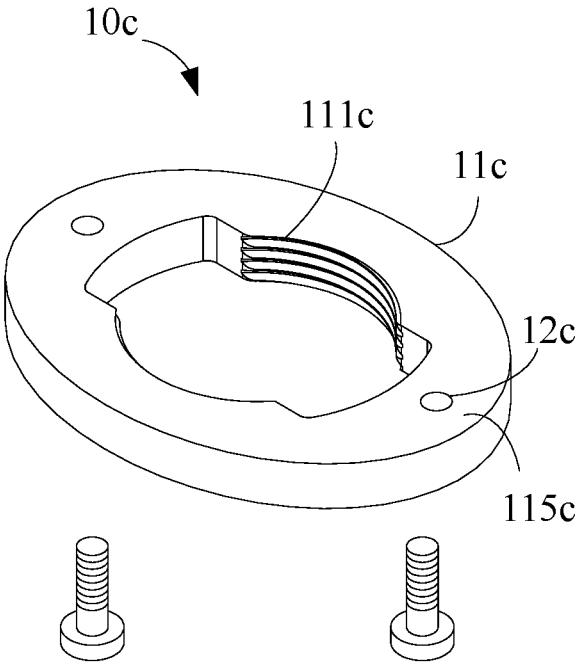
FIG. 3 is a structure diagram of a fixing assembly according to a third embodiment of the present disclosure.

Referring to FIG. 3, the present disclosure provides a fixing assembly 10*c* according to a third embodiment, and the fixing assembly 10*c* according to the third embodiment is similar in structure to the fixing assembly 10*b* according to the second embodiment. The difference between the fixing assembly 10*c* and the fixing assembly 10*b* at least includes: the fixing member 11*c* includes two long ends 115*c* disposed opposite to each other, and the second through hole 12*c* is defined in the long end 115*c*.

It should be understood that, the long end 115*c* is an end where a long axis of the fixing member 11*c* is arranged.

Figure 4:
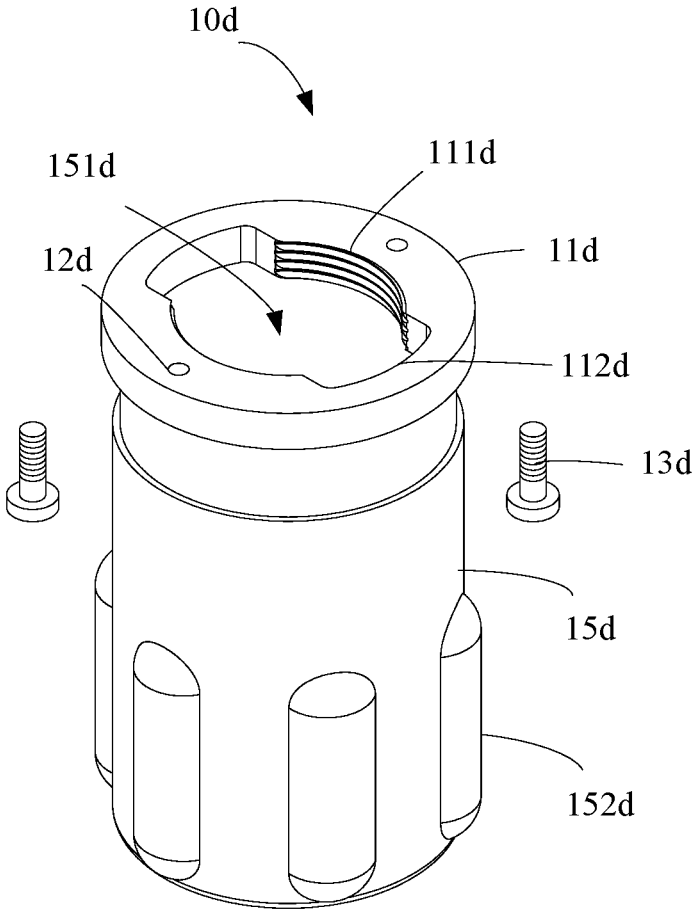
FIG. 4 is a structure diagram of a fixing assembly according to a fourth embodiment of the present disclosure.

Referring to FIG. 4, the present disclosure provides a fixing assembly 10*d* according to a fourth embodiment, and the fixing assembly 10*d* according to the fourth embodiment is similar in structure to the fixing assembly 10*a* according to the first embodiment. The difference between the fixing assembly 10*d* and the fixing assembly 10*a* at least includes: the fixing assembly 10*d* further includes a handle 15*d* connected to the fixing member 11*d*, the handle 15*d* defines a third through hole 151*d*, the third through hole 151*d* is communicated with the first through hole 111*d*. After the water pipe assembly 40 passes through the handle 15*d* and the fixing member 11*d*, and the handle 15*d* and the fixing member 11*d* are then sleeved on the mounting sleeve 50.

In at least one embodiment, the handle 15*d* is provided with at least one protrusion 152*d*. Specifically, the handle 15*d* is provided with a plurality of protrusions 152*d* arranged at intervals, so it is easy to hole the handle 15*d*.

In at least one embodiment, the handle 15*d* is integrated with the fixing member 11*d*.

In at least one embodiment, the handle 15*d* is made of plastic, the fixing member 11*d* is made of metal, and the handle 15*d* and the fixing member 11*d* are integrally formed as a single unit through an injection molding process.

In at least one embodiment, the handle 15*d* and the fixing member 11*d* are made of metal, and the handle 15*d* and the fixing member 11*d* can also be integrally formed.

In the technical solution of the present disclosure, the fixing assembly 10*d* further includes a handle 15*d* connected with the fixing member 11*d*, the handle 15*d* defines a third through hole 151*d*, the third through hole 151*d* is communicated with the first through hole 111*d*. The fixing member 11*d* can be conveniently mounted on the mounting sleeve 50 by rotating or pushing the handle 15*d*.

Figure 5:
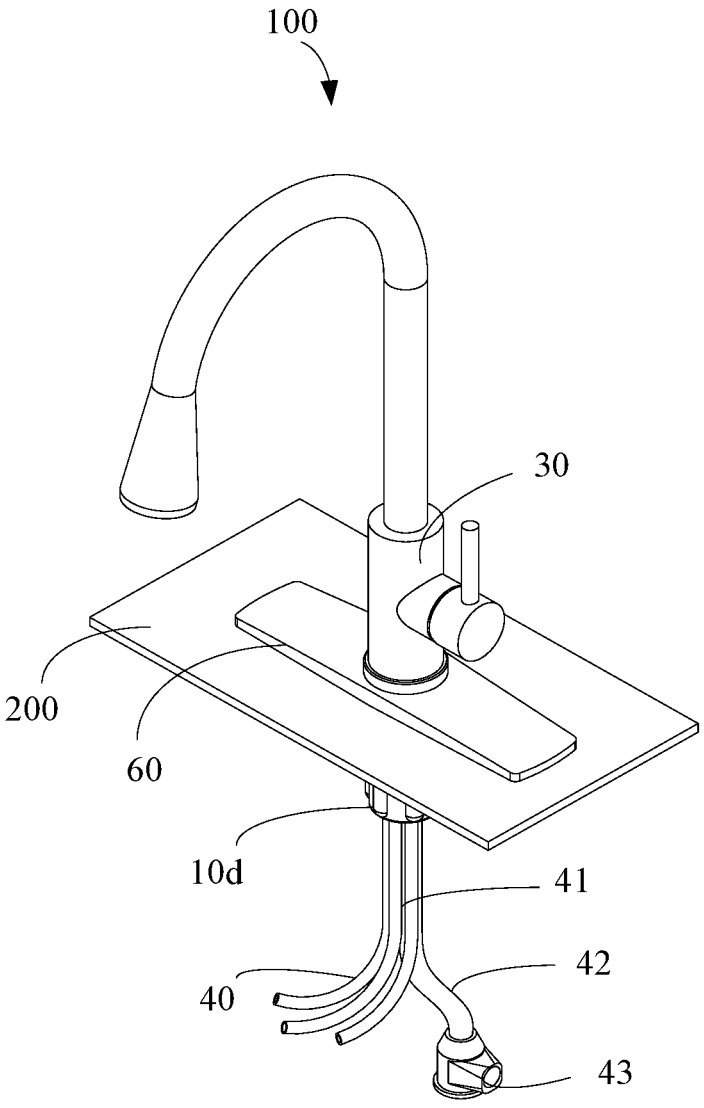
FIG. 5 is a structure diagram of a faucet and a countertop according to an embodiment of the present disclosure, the faucet is mounted on the countertop.
Figure 6:
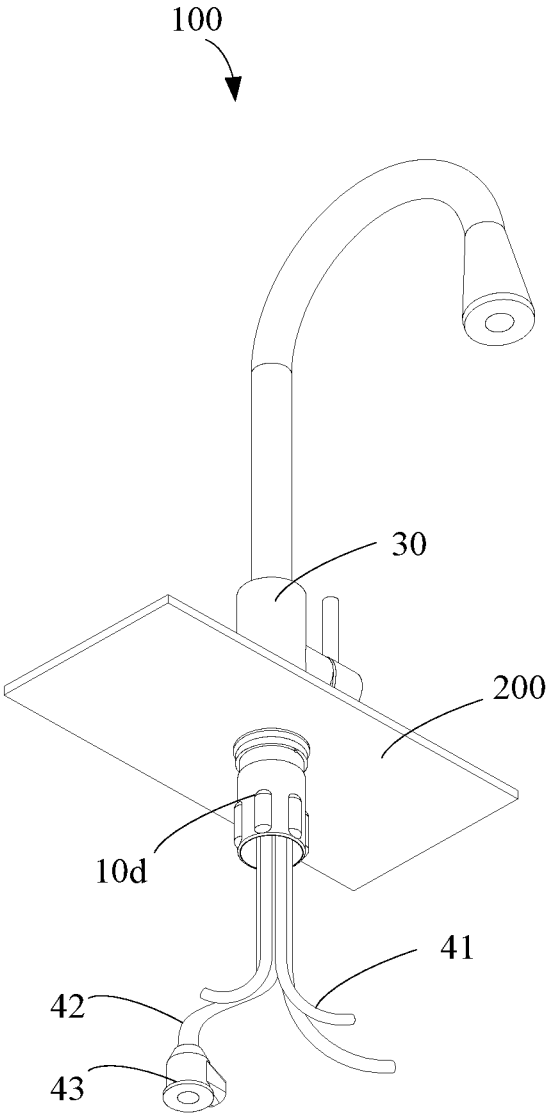
FIG. 6 is similar to FIG. 5, but shown from another view.
Figure 7:
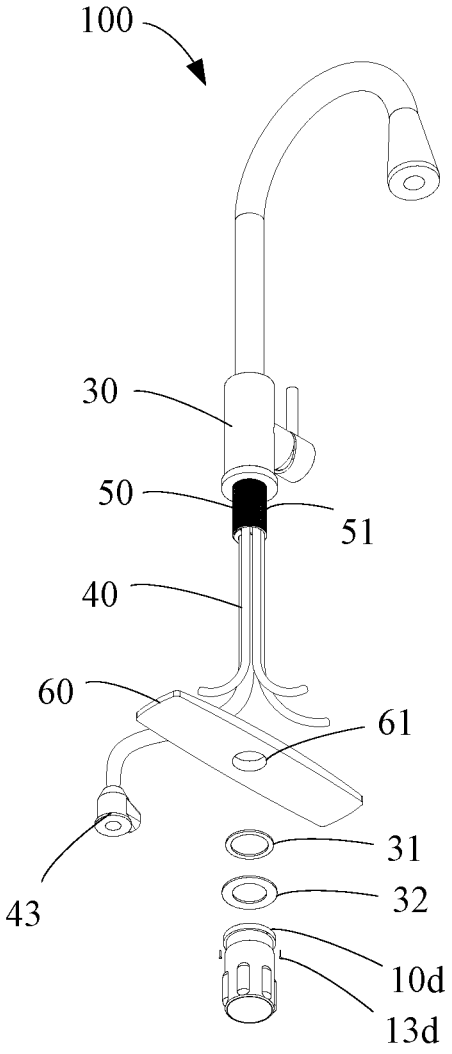
FIG. 7 is an exploded view of the faucet in FIG. 5.

Please referring to FIGS. 5 to 7, the present disclosure further provides a faucet 100. The faucet 100 includes a valve core (not shown), a protecting sleeve 30 for accommodating the valve core, a water pipe assembly 40, a mounting sleeve 50, and the fixing assembly. In the embodiment, the fixing assembly 10*d* is used as an example to illustrate how the faucet 100 is mounted with the countertop 200 by the fixing assembly 10*d*.

In at least one embodiment, the water pipe assembly 40 includes a plurality of inlet pipes 41, an outlet pipe 42, and a connecting member 43 connected to the outlet pipe 42, and a size of the via hole 112*d* is larger than a size of the connecting member 43. The inlet pipes 41 may include a hot water pipe, a cold water pipe, or the like. The connecting member 43 is sleeved on the outlet pipe 42 and is configured for connecting the outlet pipe 42 with another outlet pipe (not shown) that communicates with a water outlet 60 of the faucet 100. The size of the connecting member 43 is larger than a size of the outlet pipe 42. When the water pipe assembly 40 passes through the fixing member 11*d*, the connecting member 43 is very easy to get stuck by the fixing member 11*d*, so it is difficult for the connecting member 43 to pass through the fixing member 11*d*. Since the fixing member 11*d* further defines the via hole 112*d*, and the size of the via hole 112*d* is larger than the size of the connecting member 43, when the inlet pipe 41 and the outlet pipe 42 pass through the first through hole 111*d* of the fixing member 11*d*, the connecting member 43 can also pass through the via hole 112*d* of the fixing member 11*d* easily. Therefore, the inlet pipe 41, the outlet pipe 42, and the connecting member 43 can easily pass through the fixing member 11*d*.

In at least one embodiment, the faucet 100 further includes a first washer 31 and a second washer 32, and the first washer 31 and the second washer 32 may be arranged between the countertop 200 and the fixing member 11*d*, so the fixing member 11*d* can be stably mount the faucet 100 with the countertop 200.

In at least one embodiment, the first washer 31 is made of silicone or plastic. The second gasket 32 is made of metal.

In at least one embodiment, the first washer 31 is sandwiched between the second washer 32 and the countertop 200.

In at least one embodiment, the retaining member 13*d* is retained against a surface of the second washer 32 adjacent to the fixing member 11*d*.

In at least one embodiment, the retaining member 13*d* is extended out of the second through hole 12*d* and retained against the surface of the second washer 32 adjacent to the fixing member 11*d*.

In at least one embodiment, the free end of the retaining member 13*d* is flush with the surface of the fixing member 11*d* adjacent to the countertop 200, and retained against the surface of the second washer 32 adjacent to the fixing member 11*d*.

In at least one embodiment, the free end of the retaining member 13*d* is extended out of the surface of the fixing member 11*d* adjacent to the countertop 200, and retained against the surface of the countertop 20 adjacent to the fixing member 11*d*.

In at least one embodiment, the faucet 100 further includes a decorating member 60, the decorating piece 60 is sleeved on the mounting sleeve 50 and sandwiched between the protecting cover 30 and the countertop 200. The decorating member 60 defines a fourth through hole 61, and the mounting sleeve 50 can pass through the fourth through hole 61.

As the faucet 100 adopts all the technical proposals of the above exemplary embodiments, the faucet 100 at least has all of the beneficial effects of the technical proposals of the above exemplary embodiments, no need to repeat again.

The above description is merely some embodiments. It should be noted that for one with ordinary skills in the art, improvements can be made without departing from the concept of the present disclosure, but these improvements shall fall into the protection scope of the present disclosure.

What is claimed is:

1. A fixing assembly, configured to mount a faucet with a countertop, the faucet comprises a mounting sleeve passed through the countertop and configured to mount a water pipe assembly, wherein the water pipe assembly comprises a plurality of water pipes and a connecting member sleeving an outside of at least one water pipe of the plurality of water pipes, the connecting member is configured to connect the at least one water pipe with an external water pipe;

the fixing assembly comprises:

a fixing member, defining:

a first through hole; and at least one via hole, penetrating the fixing member and communicated with the first through hole in a radial direction of the fixing member, a receiving size formed by both the first through hole and the via hole is greater than a size of the plurality of water pipes and the connecting member to facilitate the plurality of water pipes and the connecting member to pass through the first through hole and the at least one via hole of the fixing member, and the fixing member is sleeved on the mounting sleeve and retained against the countertop, to mount the faucet with the countertop.

2. The fixing assembly according to claim 1, wherein the fixing member is circular shaped, oval shaped, square shaped, or irregular shaped.

3. The fixing assembly according to claim 1, wherein the via hole extends through two opposite surfaces of the fixing member; and/or the via hole extends into and about a wall of the first through hole; and/or a quantity of the at least one via hole is more than one, and the at least one via hole are spaced apart from each other or opposite to each other.

4. The fixing assembly according to claim 1, wherein the first through hole extends through two opposite surfaces of the fixing member; and/or a wall of the first through hole comprises an inner thread, the inner thread is connected with an outer thread of the mounting sleeve.

5. The fixing assembly according to claim 1, wherein the fixing member further defines at least one second through hole, and the fixing assembly further comprises at least one retaining member, the retaining member is received in the second through hole and retained against the countertop, so as to mount the faucet with the countertop.

6. The fixing assembly according to claim 5, wherein when the fixing member is oval, the fixing member comprises two long ends opposite to each other, the second through hole is defined in the long end.

7. The fixing assembly according to claim 5, wherein the first through hole is separated from the second through hole.

8. The fixing assembly according to claim 1, wherein the fixing assembly further comprises a handle connected with the fixing member, the handle defines a third through hole communicated with the first through hole, the handle is mounted on the mounting sleeve.

9. The fixing assembly according to claim 8, wherein the handle is provided with at least one protrusion; and/or the handle and the fixing member are integrally formed as a single unit.

10. A faucet, comprising a protecting sleeve, a water pipe assembly, a mounting sleeve, and a fixing assembly as recited in claim 1.

11. The faucet according to claim 10, wherein the plurality of water pipes comprise an outlet pipe, and the connecting member is connected with the outlet pipe, a size of the via hole is greater than a size of the connecting member.

12. The faucet according to claim 10, wherein the fixing assembly further comprises at least one washer, the washer is sandwiched between the countertop and the fixing member, the fixing member is sleeved on the mounting sleeve and retained against the washer, to mount the faucet with the countertop.

13. The faucet according to claim 12, wherein the fixing member further defines at least one second through hole, and the fixing assembly further comprises at least one retaining member, the retaining member is received in the second through hole and retained against the washer, so as to mount the faucet with the countertop.

14. The faucet according to claim 13, wherein when the fixing member is oval, the fixing member comprises two long ends opposite to each other, the second through hole is defined in the long end.

15. The faucet according to claim 13, wherein the first through hole is separated from the second through hole.

16. The faucet according to claim 10, wherein the first through hole extends through two opposite surfaces of the fixing member; and/or a wall of the first through hole comprises an inner thread, the inner thread is connected with an outer thread of the mounting sleeve.

17. The faucet according to claim 10, wherein the via hole extends through two opposite surfaces of the fixing member; and/or the via hole extends into and about a wall of the first through hole; and/or a quantity of the at least one via hole is more than one, and the at least one via hole are spaced apart from each other or opposite to each other.

18. The faucet according to claim 10, wherein the fixing assembly further comprises a handle connected with the fixing member, the handle defines a third through hole communicated with the first through hole, the handle is mounted on the mounting sleeve.

19. The faucet according to claim 18, wherein the handle is provided with at least one protrusion; and/or the handle and the fixing member are integrally formed as a single unit.

20. A faucet, arranged with a countertop and comprising a protecting sleeve, a water pipe assembly, a mounting sleeve, and a fixing assembly;

wherein, the mounting sleeve sleeves an outside of the water pipe assembly and is a one-piece structure extending from a surface of the countertop near the protecting sleeve to a surface of the countertop away from the protecting sleeve; the mounting sleeve has a portion protrudes out of the surface of the countertop away from the protecting sleeve; the mounting sleeve is configured to mount a water pipe assembly, wherein the fixing assembly comprises:

a fixing member, defining:

a first through hole; and at least one via hole, communicated with the first through hole, the first through hole and the via hole are configured to facilitate the water pipe assembly to pass through the fixing member, and the fixing member is sleeved on the protruding portion of the mounting sleeve and retained against the countertop, to mount the faucet with the countertop.

* * * * *